US008702334B2

(12) United States Patent
Geminiani

(10) Patent No.: US 8,702,334 B2
(45) Date of Patent: Apr. 22, 2014

(54) FOUNTAIN PEN

(75) Inventor: Marco Geminiani, Bologna (IT)

(73) Assignee: Gian Luca Malaguti (IT)

( * ) Notice: Subject to any disclaimer, the term of this patent is extended or adjusted under 35 U.S.C. 154(b) by 502 days.

(21) Appl. No.: 12/993,448

(22) PCT Filed: May 7, 2009

(86) PCT No.: PCT/IB2009/051884

§ 371 (c)(1),
(2), (4) Date: Nov. 18, 2010

(87) PCT Pub. No.: WO2009/141747

PCT Pub. Date: Nov. 26, 2009

(65) Prior Publication Data

US 2011/0076089 A1 Mar. 31, 2011

(30) Foreign Application Priority Data

May 20, 2008 (IT) ..... BO08A0311
Jun. 9, 2008 (IT) ..... BO08A0362

(51) Int. Cl.
*B43K 23/12* (2006.01)

(52) U.S. Cl.
USPC ..... 401/245; 401/243; 401/152; 401/155

(58) Field of Classification Search
USPC ..... 401/202, 243, 244, 245, 246, 247, 269, 401/152, 155, 156, 157, 158; 222/95, 105, 222/106, 206, 214
See application file for complete search history.

(56) References Cited

U.S. PATENT DOCUMENTS

| | | | | |
|---|---|---|---|---|
| 2,096,708 | A | 10/1937 | Cuthbert | |
| 2,217,884 | A | 10/1940 | Andrews | |
| 2,542,267 | A | 2/1951 | Edward | |
| 2,753,846 | A | 7/1956 | Miessner | |
| 7,384,208 | B2 * | 6/2008 | Bouix et al. | 401/269 |

FOREIGN PATENT DOCUMENTS

| | | |
|---|---|---|
| FR | 993929 | 11/1951 |
| JP | 042956 | 4/1917 |
| JP | 018733 | 9/1925 |
| JP | 54-15707 | 6/1979 |
| JP | H09-123664 | 5/1997 |

OTHER PUBLICATIONS

International Search Report and Written Opinion dated Aug. 21, 2009 from corresponding application.

* cited by examiner

*Primary Examiner* — David Walczak
(74) *Attorney, Agent, or Firm* — Timothy J. Klima; Shuttleworth & Ingersoll, PLC

(57) ABSTRACT

An improved fountain pen (1) comprises a hollow barrel (2) with a longitudinal central axis of extension (X), a nib (3) located at a first longitudinal end (2*a*) of the barrel (2), an ink reservoir (4) located inside the barrel (2) and designed to feed the ink to the nib (3), a piston (5) able to move axially along the central axis (X) to create a vacuum inside the ink reservoir (4); the ink reservoir (4) also comprising a sac (6) made of deformable material.

22 Claims, 4 Drawing Sheets

FOUNTAIN PEN

This application is the National Phase of International Application PCT/IB32009/051884 filed May 7, 2009 which designated the U.S. and that International Application was published under PCT Article 21(2) in English, This application claims priority to Italian Patent Application No. BO2008A000311 filed May 20, 2008, Italian Patent Application No. BO2008A000362 filed Jun. 9, 2008 and PCT Application No. PCT/IB2009/051884 filed May 7, 2009, which applications are incorporated by reference herein.

TECHNICAL FIELD

The present invention relates to an improved fountain pen.

In particular, the present invention relates to a fountain pen of the type with a refillable ink reservoir.

BACKGROUND ART

There are many prior art solutions and methods for filling the ink reservoir with ink.

Amongst the various systems commonly used, with the passage of time the use of vacuum filling became established, due to its practicality and effectiveness.

The system involves filling by creating a vacuum inside the pen body so that the ink is sucked in by it.

The most used method involves syringe filling, which uses the more classic method for creating a vacuum: that of moving a plunger backwards in a cylindrical hollow body, precisely as occurs for syringes.

That system is simple to make from a mechanical viewpoint and is usually made with a shaft inserted through a hole in the end part of the pen.

At the other end of the shaft, inserted in the pen body, a seal is mounted.

Filling is performed by accessing the shaft from the rear of the pen and pushing it as far as it will go, then sucking in the ink, exactly as occurs with a syringe, by pulling the shaft backwards.

The most used mechanism for the movement of the shaft/plunger is of the male and female screw type.

Turning the end part of the pen (the bottom) makes the shaft/plunger move forwards or backwards and causes consequent emptying/filling of the ink from/to the inside of the ink reservoir.

Like any cylinder-piston type connection, prolonged use compromises the seal between the two components, causing unwanted ink leaks, with the obvious risk that ink may get out of the ink reservoir.

Moreover, fountain pens comprise a nib in fluid communication with the ink reservoir through a channel which allows the ink to pass from the ink reservoir to the nib.

Some such pens also comprise a nib closing cap which is applied to the end of the barrel after the pen has been used.

Ink is often leaked from the channel connecting the ink reservoir to the nib, even when the pen is not used and the cap is applied to the barrel.

Such leaks are more frequent if the pen is in environments in which the temperature or the pressure vary, for example during aeroplane flights.

Leaks cause unwanted marks on clothing (for example, a shirt or jacket pocket) or the containers where the pen is put away.

DISCLOSURE OF THE INVENTION

The present invention has for an aim to provide an improved fountain pen which is free of the disadvantages described above and which at the same time has a simple structure, is practical to use and operates effectively.

In particular, the present invention has for an aim to provide a fountain pen equipped with components which guarantee an effective ink seal.

The technical features of the present invention, in accordance with the above aim, are clear from the content herein.

BRIEF DESCRIPTION OF THE DRAWINGS

The advantages of the present invention are more apparent in the detailed description which follows, with reference to the accompanying drawings which illustrate a preferred, non-limiting embodiment of the invention, in which.

DETAILED DESCRIPTION OF THE PREFERRED EMBODIMENTS OF THE INVENTION

Figure 1:
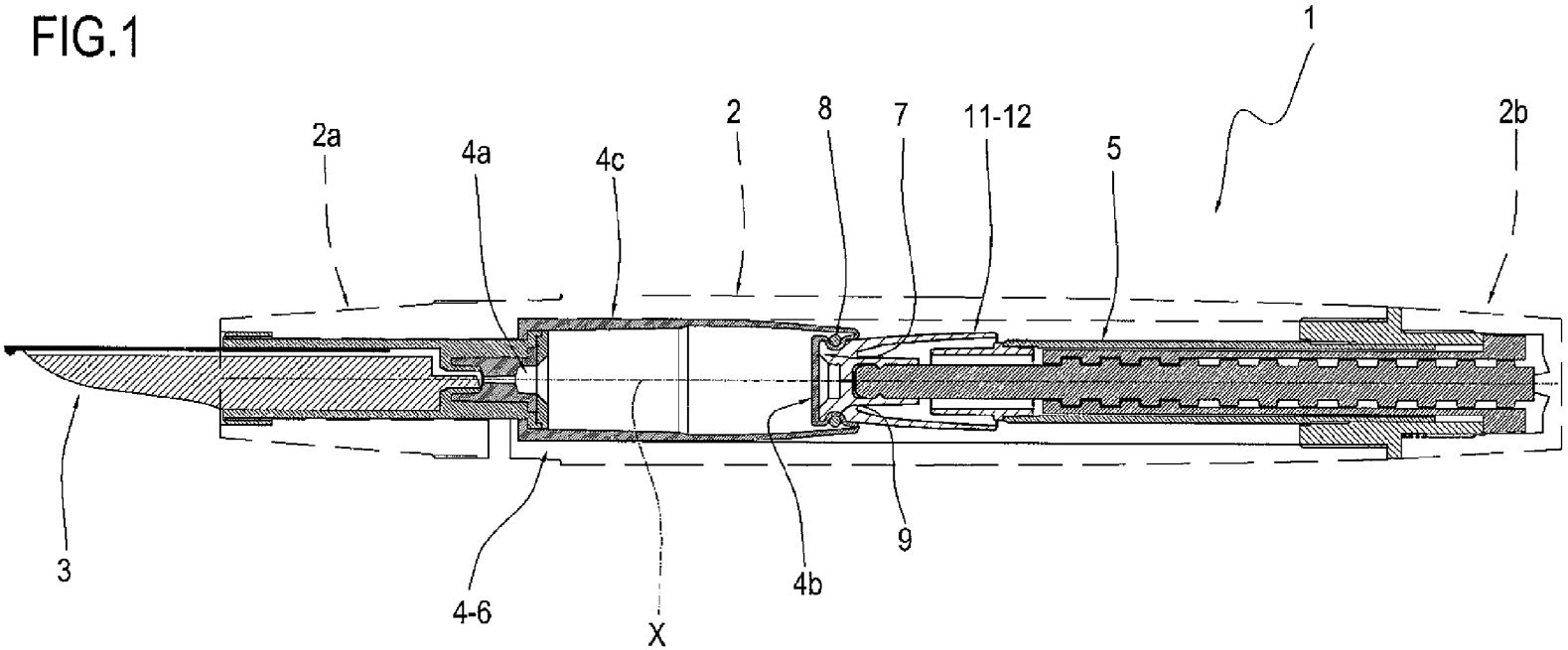
FIG. 1 is a schematic cross-section of a preferred embodiment of the fountain pen according to the present invention.

With reference to the accompanying drawings and in particular to FIG. 1, the numeral 1 denotes as a whole a fountain pen made according to the present invention.

The pen 1 comprises a substantially cylindrical hollow barrel 2, forming the outer casing of the pen 1 and intended to be gripped by the user during normal use of the pen.

The pen 1 has a longitudinal central axis of extension X. The hollow barrel 2 extends along said longitudinal axis X and comprises two ends, a first end 2*a* and a second end 2*b*.

A nib 3, usually made of metal material, is connected to the first end 2*a* of the barrel 2.

Inside the barrel 2 there is an ink reservoir 4, designed to feed ink to the nib 3, and a piston 5, able to move axially inside the barrel 2 to create a vacuum inside the ink reservoir 4 by compressing/decompressing the ink reservoir 4 with its axial movement.

The mechanism used for the axial movement of the piston 5 is of the known type (a male-and-female screw coupling) and therefore is not described in further detail.

The ink reservoir 4 comprises a sac 6 made of deformable material such as silicone and extends inside the barrel 2, along the longitudinal central axis of extension X.

Figure 2:
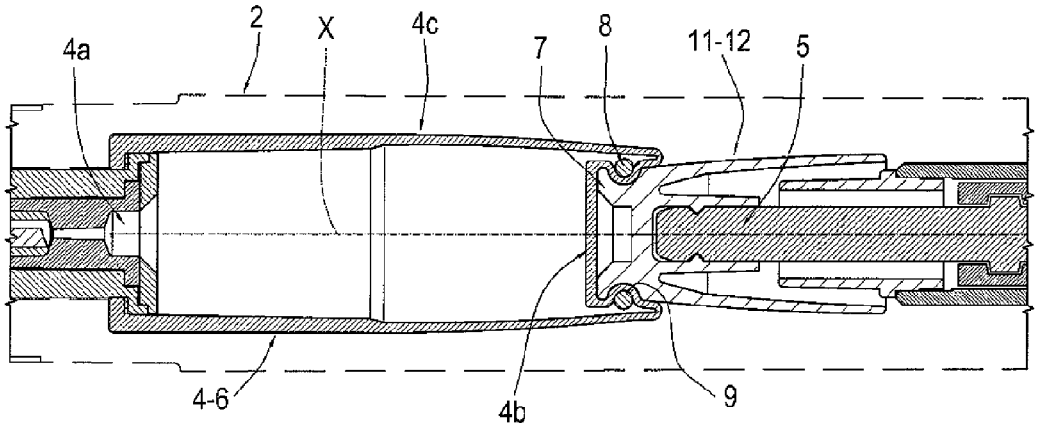
FIG. 2 is a schematic cross-section of a detail of the pen of FIG. 1 in a first operating configuration.

As FIGS. 1 and 2 show, the shape of the ink reservoir 4 is at least roughly cylindrical and it has two opposite longitudinal ends, a first end 4*a* and a second end 4*b* as well as a cylindrical lateral wall 4*c*.

The first end 4*a* is open, so that the ink reservoir 4 is in fluid communication with the nib 3, allowing the ink to flow towards the nib 3.

The second end 4*b* of the ink reservoir 4 is closed and is connected to the end part 7 of the piston 5.

In more detail, in the embodiment illustrated in FIGS. 1, 2, 3 and 4 the second end 4*b* of the ink reservoir 4 is fixed to the end part 7 of the piston 5 by a circumferential ring 8 inserted in a respective groove 9 made in the end part 7 of the piston.

The second end 4*b* of the ink reservoir 4 remains interposed between the circumferential ring 8 and the groove 9.

Figure 3:
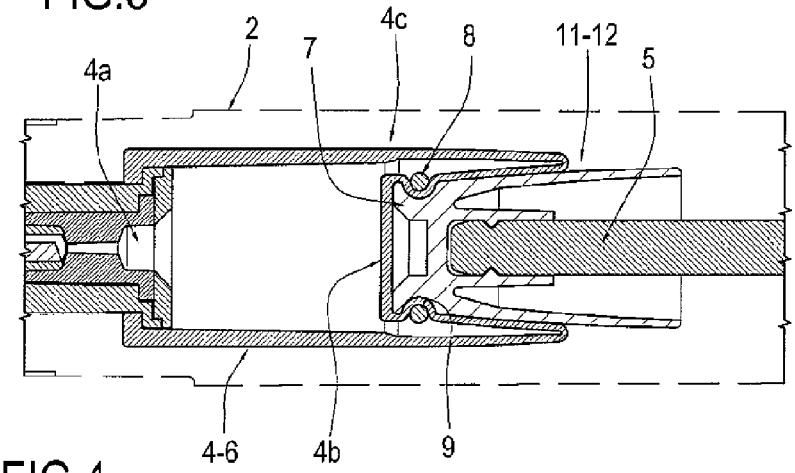
FIG. 3 is a schematic cross-section of the detail of FIG. 2 in a second operating configuration.
Figure 4:
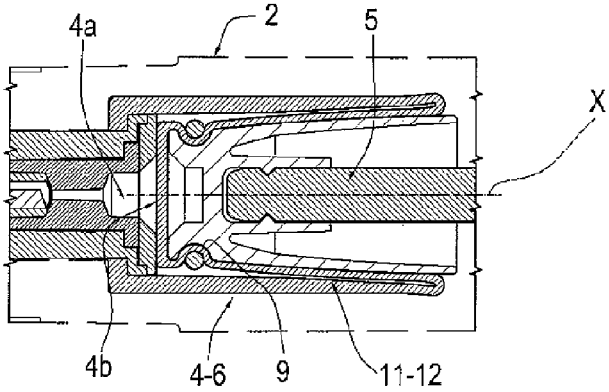
FIG. 4 is a schematic cross-section of the detail of FIG. 2 in a third operating configuration.
Figure 5:
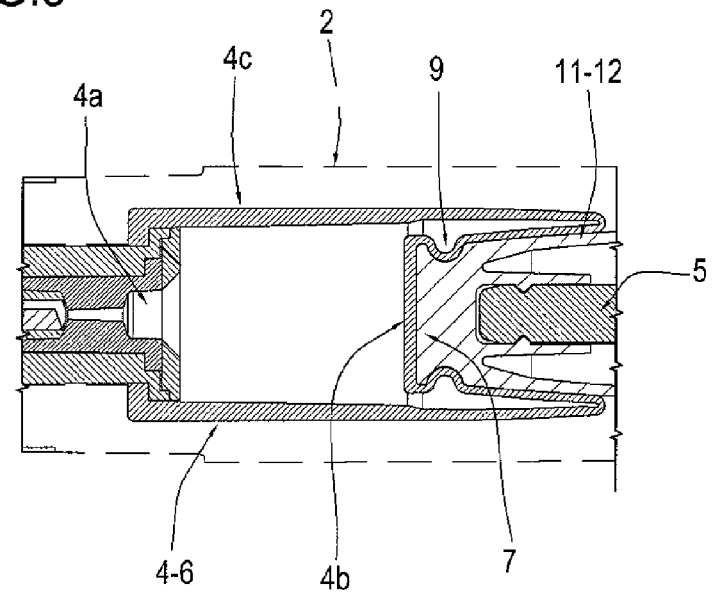
FIG. 5 illustrates a second, alternative embodiment of the detail of FIGS. 2, 3 and 4.

FIG. 5 shows an alternative embodiment of the pen in FIGS. 1 to 4, in which the second end 4*b* of the ink reservoir 4 is connected to the end part 7 of the piston 5 by gluing.

Figure 6:
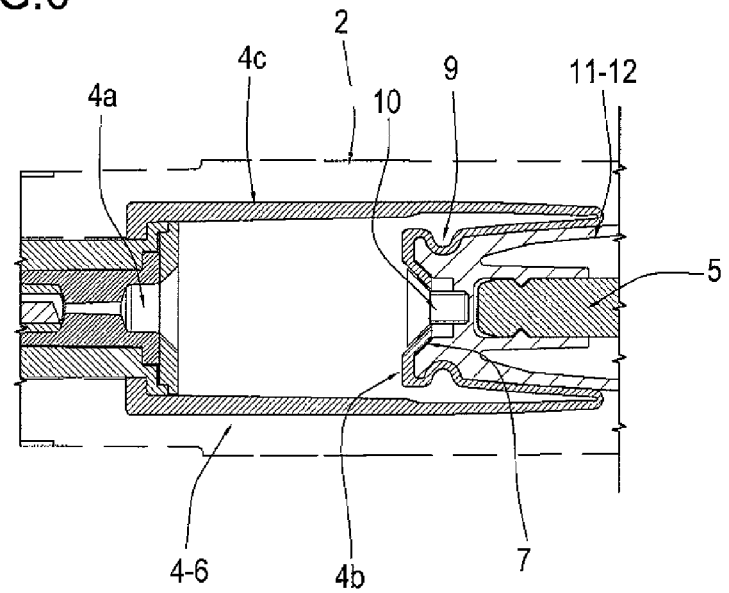
FIG. 6 illustrates a third, alternative embodiment of the detail of FIGS. 2, 3 and 4.

In FIG. 6, according to another alternative embodiment of the present invention, the second end 4*b* of the ink reservoir 4 is fixed to the end part 7 of the piston 5 by a screw 10 passing through the second end 4*b* of the ink reservoir 4 and which engages by screwing in the end part 7.

In practice, as shown in detail in FIGS. 2, 3 and 4, the ink reservoir 4 is deformable between a first limit position with maximum internal volume, in which the two ends 4*a*, 4*b* of the ink reservoir 4 are distanced from each other, and a second position with reduced internal volume, in which the first end 4*a* and the second end 4*b* of the ink reservoir 4 are close together.

In practice, the cylindrical lateral wall 4*c* of the ink reservoir 4, pushed by the piston 5, folds inwards in such a way that portions of the wall 4*c* overlap each other, maintaining a cylindrical shape.

The piston 5 comprises an element 11 which acts as a guide and maintains the shape of the ink reservoir 4.

The guide element 11 comprises a cylindrical block 12 with a diameter which is smaller than the diameter of the ink reservoir 4.

In more detail, the diameter of the guide element 11 is slightly smaller than the diameter of the ink reservoir 4, so that when the cylindrical lateral wall 4*c* of the ink reservoir 4 folds inwards, the guide element 11 keeps the inner portion of lateral wall 4*c* drawn near to the corresponding outer portion of cylindrical lateral wall 4*c*, as FIG. 4 clearly shows.

Moreover, as shown in the accompanying drawings, the thickness of the cylindrical lateral wall 4*c* of the ink reservoir 4 varies along the axis X, facilitating inward folding of the lateral wall 4*c*.

According to an alternative embodiment not illustrated, the cylindrical lateral wall has at least one circumferential preferred folding line.

Figure 7:
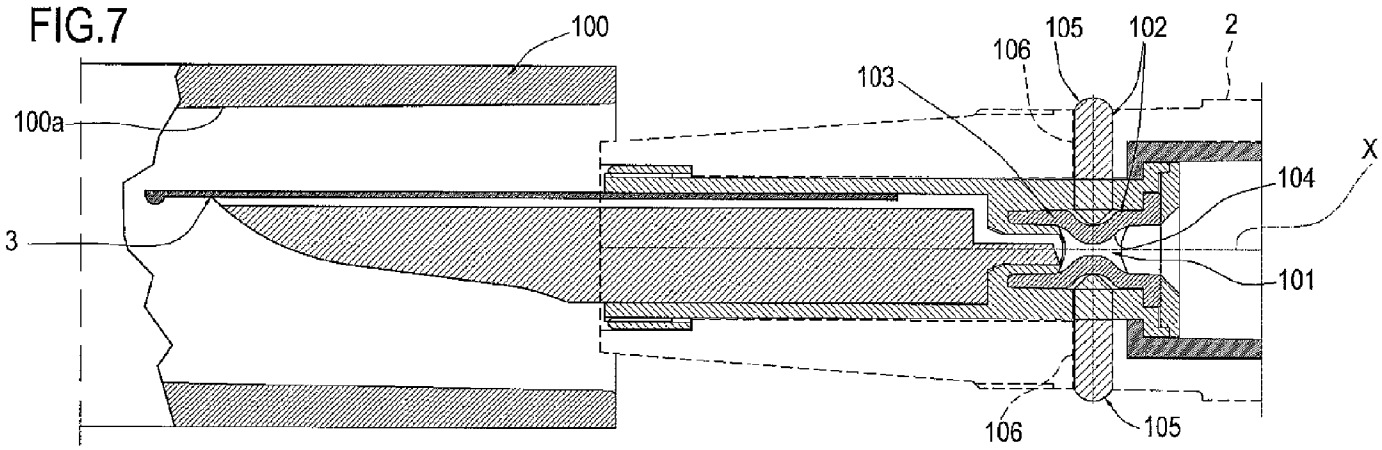
FIG. 7 is a schematic cross-section, with some parts cut away to better illustrate others, of a detail of the pen according to a fourth, alternative embodiment, in a first operating position.
Figure 8:
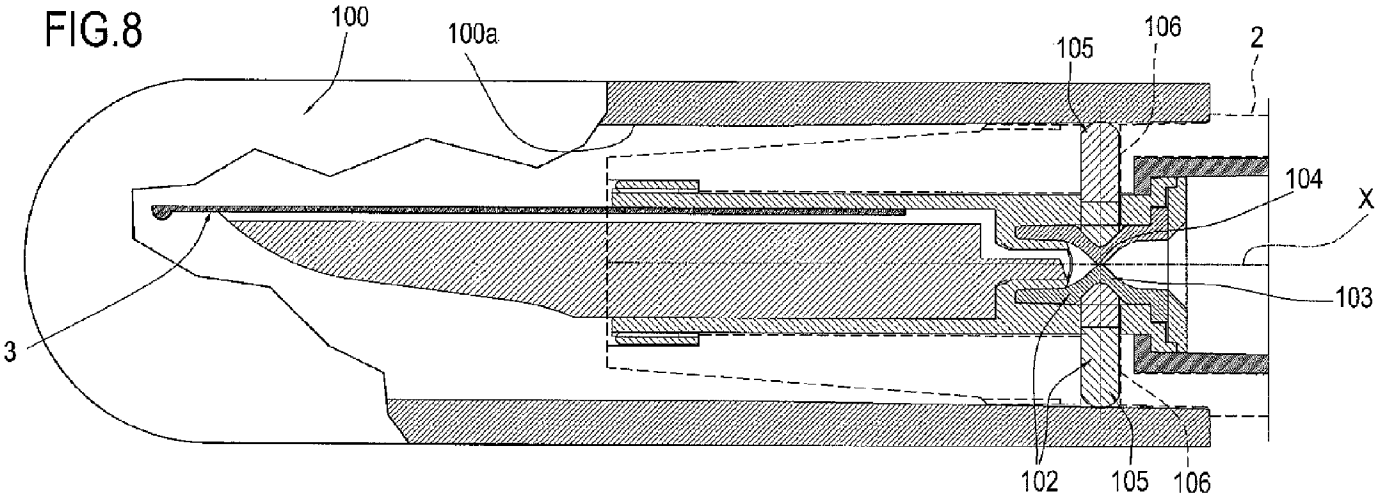
FIG. 8 is a schematic cross-section, with some parts cut away to better illustrate others, of a detail of the pen according to a fourth, alternative embodiment, in a second operating position.

FIGS. 7 and 8 show another possible alternative embodiment of the fountain pen according to the present invention.

According to that alternative embodiment, the pen 1 also comprises a cap 100 for covering the nib 3. The cap can be applied to the first end 2*a* of the barrel 2.

The cap 100 is applied to the barrel 2 when the pen 1 is not being used.

The nib 3 is in fluid communication with the ink reservoir 4 by means of a channel 101 through which ink flows from the ink reservoir 4 to the nib 3.

As illustrated in FIGS. 7 and 8, the pen comprises valve means 102 for closing the channel 101.

The valve means 102 comprise a substantially cylindrical body 103 which is hollow inside and elastically deformable.

The cylindrical body 103 is made of silicone material and has an inner wall 104.

The cylindrical body 103 can move between an open position, illustrated in FIG. 7, in which the channel 101 for the passage of the ink is open, and a closed position, illustrated in FIG. 8, in which the channel 101 is closed.

Advantageously, as shown in FIGS. 7 and 8, the inner wall of the cylindrical body 103 forms a wedge shape towards the axis X, in such a way that in the closed position the surfaces of the cylindrical body 103 which make contact to close the channel 101 are limited to the vertex of the wedge: in that way the seal is significantly increased.

The valve means 102 also comprise a pair of cylindrical body 103 actuator pins 105, inserted in respective cavities 106 made in the barrel 2 and able to move in a direction transversal to the direction identified by the axis X.

The pins 105 move, inside the cavities 106, between a raised position corresponding to the cylindrical body 103 open position (illustrated in FIG. 7) and a lowered position in which they move the cylindrical body 103 to the closed position (illustrated in FIG. 8).

When the pen 1 is in the operating condition, the pins 105 are in the raised position, allowing the passage of ink.

As shown in FIG. 8, when the cap 100 is applied to the barrel 2, when the user has finished using the pen 1, the inner wall 100*a* of the cap 100 pushes the pins 105 into the lowered position, the pins 105, in turn, moving the cylindrical body 103 into the closed position.

In this way, when the cap 100 is put on, the possibility of ink passing from the channel 101 towards the nib 3 is automatically eliminated, because the channel 101 is closed.

Similarly, when the cap 100 is removed, the cylindrical body 103 elastically deforms and again moves the pins 105 to the open position. The channel 101 opens again and ink flows towards the nib 3.

The pen 1 also comprises locking means for the pins 105 which prevent the pins 105 from slipping out of their cavities 106.

The locking means comprise a stop element designed to prevent the pin 105 from sliding beyond the open position towards the outside of the cavity 106.

The present invention brings important advantages.

The piston always remains outside the ink reservoir and does not act directly on the ink, instead acting on the ink reservoir, which, as already indicated, deforms by folding inwards.

In that way, the top of the ink reservoir forms a closed chamber absolutely preventing the possibility of any ink leaks outside the ink reservoir.

The ink can only flow out towards the nib from the open end of the ink reservoir, but cannot flow out of the top, thanks to the fact that the ink reservoir is closed and the piston acts on the ink reservoir from the outside.

Moreover, the valve means prevent ink leaks each time the cap is applied to the barrel, thus preventing unwanted marks on clothing or in the containers where the pen is put away.

The ink can only flow out towards the nib from the open end of the ink reservoir, said end being closed by the valve means when the cap is applied to the barrel.

The invention claimed is:

1. An improved fountain pen comprising:

a hollow barrel with a longitudinal central axis of extension;

a nib located at a first longitudinal end of the barrel;

an ink reservoir located inside the barrel and adapted for holding ink for supply to the nib;

a piston movable axially along the central axis to create a vacuum inside the ink reservoir, the ink reservoir including a sac;

a channel connecting the nib to the ink reservoir;

a valve mechanism for closing the channel;

a cap for covering the nib and which can be applied to the barrel at the first end, the cap interacting with the valve mechanism;

wherein the ink reservoir comprises a flexible cylindrical wall which is foldable upon itself such that portions of the cylindrical wall overlap each other, the cylindrical wall including a thickness which varies along the central axis to facilitate folding of the cylindrical wall upon itself.

2. The fountain pen according to claim 1, wherein the valve mechanism comprises an elastically deformable cylindrical body surrounding the channel, being movable between an open position, in which the channel is open for passage of the ink when the pen is in use, and a closed position, in which the cylindrical body is elastically deformed to close the channel by application of the cap onto the barrel.

3. The fountain pen according to claim 2, wherein an inner wall of the cylindrical body forms a wedge shape towards the central axis, in such a way that in the closed position the surfaces of the cylindrical body which make contact to close the channel are limited to a vertex of the wedge.

4. The fountain pen according to claim 2, and further comprising a pair of pins designed to move the cylindrical body from the open position to the closed position.

5. The fountain pen according to claim 4, wherein the pins are operated by the cap, when the cap is applied to the first end of the barrel.

6. The fountain pen according to claim 2, wherein the piston comprises an element which acts as a guide and maintains a shape of the ink reservoir during movement between the open position and closed position and vice versa.

7. The fountain pen according to claim 1, wherein the ink reservoir is made of silicon material, extends along the central axis and has two opposite longitudinal ends, one of the ends being open to put the ink reservoir in communication with the nib, via the valve mechanism, and that the ink reservoir is deformable at least between a first limit position with maximum internal volume, in which the ends of the ink reservoir are distanced from each other, and a second position with reduced internal volume, in which the ends of the ink reservoir are close together.

8. The fountain pen according to claim 1, wherein the cylindrical wall includes at least one circumferential preferred folding line of different thickness than an adjacent portion of the cylindrical wall.

9. The fountain pen according to claim 1, wherein the piston is connected to a mobile end of the ink reservoir.

10. The fountain pen according to claim 1, wherein the piston is connected to a mobile end of the ink reservoir by a circumferential ring housed in a groove made in an end of the piston.

11. The fountain pen according to claim 1, wherein the piston is connected to a mobile end of the ink reservoir by gluing.

12. The fountain pen according to claim 1, wherein the flexible cylindrical wall includes a thicker portion which remains unfolded and a thinner portion which folds onto the thicker portion to overlap the thicker portion.

13. An improved fountain pen comprising:

a hollow barrel with a longitudinal central axis of extension;

a nib located at a first longitudinal end of the barrel;

an ink reservoir located inside the barrel and adapted for holding ink for supply to the nib;

a piston movable axially along the central axis to create a vacuum inside the ink reservoir, the ink reservoir including a sac;

a channel connecting the nib to the ink reservoir;

a valve mechanism for closing the channel;

a cap for covering the nib and which can be applied to the barrel at the first end, the cap interacting with the valve mechanism;

wherein the ink reservoir comprises a flexible cylindrical wall which is foldable upon itself such that portions of the cylindrical wall overlap each other, the cylindrical wall including at least one circumferential preferred folding line of different thickness than an adjacent portion of the cylindrical wall to facilitate folding of the cylindrical wall upon itself.

14. The fountain pen according to claim 13, wherein the valve mechanism comprises an elastically deformable cylindrical body surrounding the channel, being movable between an open position, in which the channel is open for passage of the ink when the pen is in use, and a closed position, in which the cylindrical body is elastically deformed to close the channel by application of the cap onto the barrel.

15. The fountain pen according to claim 14, wherein an inner wall of the cylindrical body forms a wedge shape towards the central axis, in such a way that in the closed position the surfaces of the cylindrical body which make contact to close the channel are limited to a vertex of the wedge.

16. The fountain pen according to claim 14, and further comprising a pair of pins designed to move the cylindrical body from the open position to the closed position.

17. The fountain pen according to claim 16, wherein the pins are operated by the cap, when the cap is applied to the first end of the barrel.

18. The fountain pen according to claim 14, wherein the piston comprises an element which acts as a guide and maintains a shape of the ink reservoir during movement between the open position and closed position and vice versa.

19. The fountain pen according to claim 13, wherein the ink reservoir is made of silicon material, extends along the central axis and has two opposite longitudinal ends, one of the ends being open to put the ink reservoir in communication with the nib, via the valve mechanism, and the ink reservoir is deformable at least between a first limit position with maximum internal volume, in which the ends of the ink reservoir are distanced from each other, and a second position with reduced internal volume, in which the ends of the ink reservoir are close together.

20. The fountain pen according to claim 13, wherein the piston is connected to a mobile end of the ink reservoir.

21. The fountain pen according to claim 13, wherein the piston is connected to a mobile end of the ink reservoir by a circumferential ring housed in a groove made in an end of the piston.

22. The fountain pen according to claim 13, wherein the piston is connected to a mobile end of the ink reservoir by gluing.

* * * * *